United States Patent [19]

Kury

[11] Patent Number: 4,515,102

[45] Date of Patent: May 7, 1985

[54] COMBINATION BOAT AND TRAILER ASSEMBLY WITH INTEGRATED RETRACTABLE TRAILER WHEEL STRUCTURE

[75] Inventor: John A. Kury, Beaumont, Tex.

[73] Assignee: Port-A-Boat, Inc., Pensacola, Fla.

[21] Appl. No.: 555,635

[22] Filed: Nov. 23, 1983

[51] Int. Cl.[3] ..... B63C 13/00

[52] U.S. Cl. ..... 114/344; 280/414.2

[58] Field of Search ..... 114/344, 270; 280/414.2, 704; 244/101, 105, 102 R

[56] References Cited

U.S. PATENT DOCUMENTS

| | | | |
|---|---|---|---|
| 2,570,528 | 10/1951 | Davis | 114/344 |
| 2,865,031 | 12/1958 | Maloney | 114/344 |
| 3,095,585 | 7/1963 | Thomas | 114/344 |
| 3,344,448 | 10/1967 | Goetz | 114/344 |

*Primary Examiner*—Sherman D. Basinger

*Attorney, Agent, or Firm*—Mason, Fenwick & Lawrence

[57] ABSTRACT

A combination boat and trailer assembly movable on land and on water having outboard wheel assemblies and support structure therefor provided in integrated relation on the boat, wherein the wheels can be lowered to form a trailering system when it is desired to tow the boat and can be raised to positions withdrawing the wheel assemblies above normal water level when the boat is waterborne. The wheel assemblies each have a pair of pivotally intercoupled articulated rigid upper and lower arms and an interconnecting shock absorber located outwardly adjacent opposite sides of the boat hull and a ground engaging wheel rotatably journaled on the lower portion of the lower arm. The shock absorber resiliently maintains the arms substantially at an acute angle to each other and a rigid axle member extends from the upper arm through a pair of axially spaced bearing members aligned along a common transverse axis and supported by an inboard mounting structure. Axle member rotating structure affixed to inboard portions of the axle members are provided for rotating the axle members to raise and lower the wheel assemblies.

15 Claims, 6 Drawing Figures

42
12
10
43
41
40
14
25
21
31
23
22
25
16
30
32
34
11
14
18
29
15
13
26
26

42
40
10
26
18
26
43
14
11
32
34
22
28
12
16
14
32
21
13
30
29
23
25

42
10
11
43
43a
44
40
12
41
14

COMBINATION BOAT AND TRAILER ASSEMBLY WITH INTEGRATED RETRACTABLE TRAILER WHEEL STRUCTURE

BACKGROUND AND OBJECTS OF THE INVENTION

The present invention relates in general to a combination boat and trailer assembly wherein the boat has built-in or integrated retractable trailer wheel structure and an automotive vehicle hitch so that the combined trailer-boat is movable on water and also may be towed on land by an automotive vehicle.

Heretofore, removable trailer wheel attachments have been proposed for boats, usually of the smaller runabout or outboard watercraft types, wherein the trailer wheels and an automotive hitch can be removably secured by screws or similar fasteners to the sides of the boat so that it can be towed by an automotive vehicle to the launch site. Examples of such prior art structures are found in U.S. Pat. Nos. 3,281,874 and 2,410,570. However, in such cases, the wheels and attachment gear were immersed in water when the boat was in the water, which of course produced undesirable turbulence or drag characteristics adversely effecting handling and maneuverability of the boat in the water, and which also subjected the wheels and support structure to rust and undue wear arising from their immersion in the water when the boat was waterborne. However, the desirability of having trailer wheel and wheel support structure and hitch structure incorporated in some way with the boat structure was recognized as desirable to reduce the much greater expense of providing a separate trailer for the boat, increasing the total weight of the trailer and boat and thus causing considerably increased gas consumption as well as the expense involved in having a separate trailer and the greater difficulty of handling a separate trailer during the process of launching the boat or withdrawing it from the water.

Also, it has been proposed in the case of larger boats such as cabin cruisers and large inboard boats to provide wells or storage spaces in the boat hull in which wheels and wheel support structure could be accommodated when the boat was in the water, providing a combined boat and trailer assembly, but in such cases the storage provisions for the wheel and support structure took up needed passenger and cargo space and resulted in bulky, cumbersome and expensive to manufacture apparatus.

An object of the present invention is the provision of a novel combined boat and trailer assembly wherein wheels and wheel support structure are provided in an outboard structural system integrated with a boat, which can be located in a lower trailering position when it is desired to tow the boat to and from launch sites and which are movable to raised positions withdrawing the wheels and support structure to a position above the normal water level when the boat is waterborne, thereby providing a more economical boat-trailer assembly movable both on land and on water, improved handling characteristics during launching of the boat and withdrawal of the boat from the water, reduced expense of manufacture, and reduced weight which permits energy saving fuel economies to be realized during land transport of the boat-trailer assembly.

Other objects, advantages and capabilities of the invention will become apparent from the following detailed description, taken in conjunction with the accompanying drawings illustrating a preferred embodiment of the invention.

DETAILED DESCRIPTION OF A PREFERRED EMBODIMENT

Figure 1:
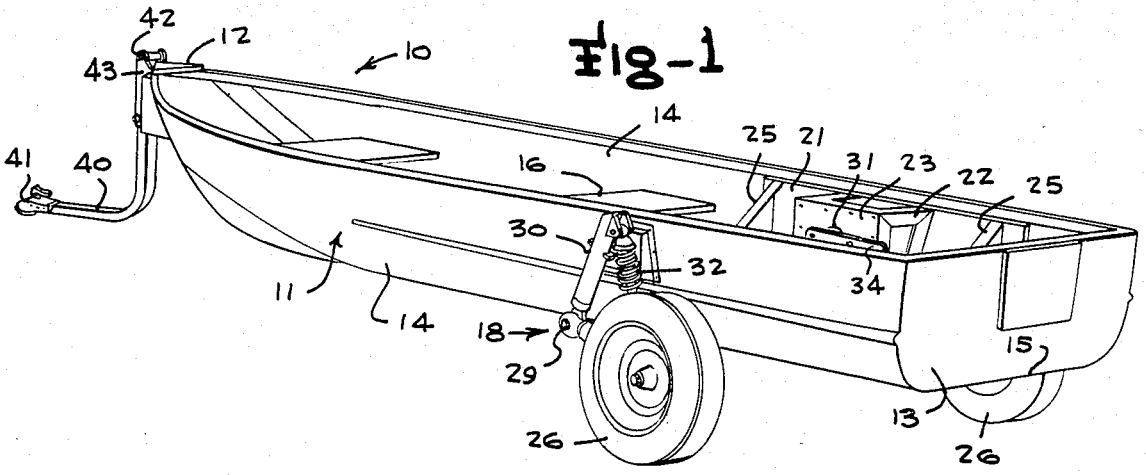
FIG. 1 is a perspective view of a combined boat and trailer assembly embodying the construction of the present invention, shown in a land transport mode ready to be towed.

Referring to the drawings, wherein like reference characters designate corresponding parts throughout the several figures, the combined boat and trailer assembly of the present invention is indicated generally by the reference character 10, and comprises a conventional boat hull 11, such as a standard runabout, an outboard powered fishing boat, or the like, of normal configuration having a bow 12 and a stern defined by a substantially conventional transom 13. The boat hull 11 in the illustrated embodiment is generally of substantially conventional metal boat construction, for example a standard aluminum boat having upwardly and somewhat outwardly inclined sides 14 merging along curved paths into the bottom 15, and including the usual seat structure 16 and conventional bracing or reinforcing formations customary in such aluminum boat construction. Alternatively, the boat hull 11 may be made of fiberglass formed in accordance with usual fiberglass boat construction methods.

Substantially midway along the after-half of the boat at the customary location of the wheels for conventional separate boat trailers, the assembly 10 of the present invention is provided with retractable wheel assemblies 18 supported along the sides 14 by reinforcing wheel mount frame assemblies 19 and a reinforcement rib system 20.

The reinforcing wheel mount frame assemblies 19 comprise, generally, a pair of reinforcing side plates 21 formed of metallic plates of suitable strength positioned against the inner surfaces of the boat hull sides 14 and welded to the metallic sides of the boat hull along the edges of the side plates 21, to which are welded generally box-like mounting frames 22 formed of metallic frame members **22*a*, or in the case of a fiberglass boat, an extra heavy layer of fiberglass is built up at these areas. In the mounting frames 22 shown, the members 22*a*, for example, are angle-section beam members having flanges disposed perpendicular to each other, welded together in a box-like structure, or cast in metal of one or more sections and welded or bolted together, with flanges of the vertical and horizontal members at the innermost end of the frame located in a vertical plane and supporting vertical metallic plates 23. Bottom reinforcing ribs 24 transversely span the bottom of the boat hull and include two ribs welded to the two lateral mounting frames 22 to lend appropriate additional support to the trailer wheel region, and two similar reinforcing ribs 24***a* spaced forwardly and rearwardly from the mounting frames 22 and welded to gusset plates 25 which are also welded to the reinforcing side plates 21 adjacent the forwardmost and rearmost edges to provide suitable support for the trailer wheel region of the combined boat and trailer assembly. Similar reinforcement is to be provided in the case of a fiberglass boat hull.

Figure 4:
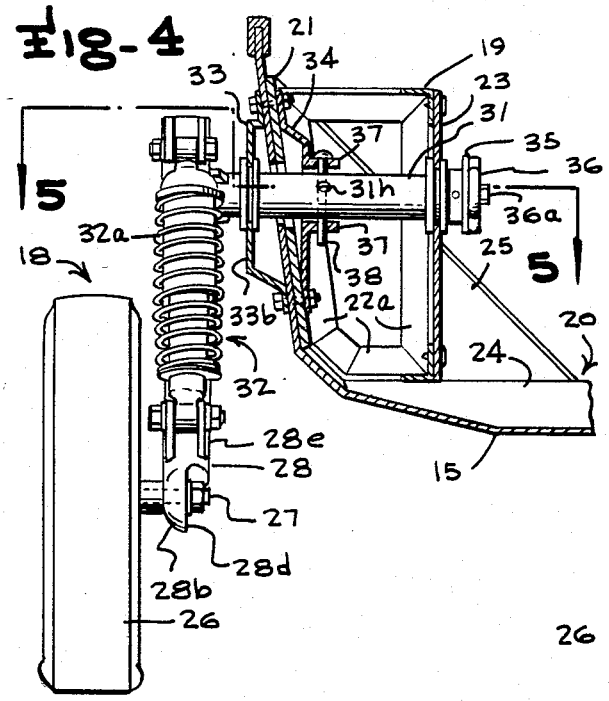
FIG. 4 is a vertical section view taken along the line 4—4 of FIG. 3.
Figure 5:
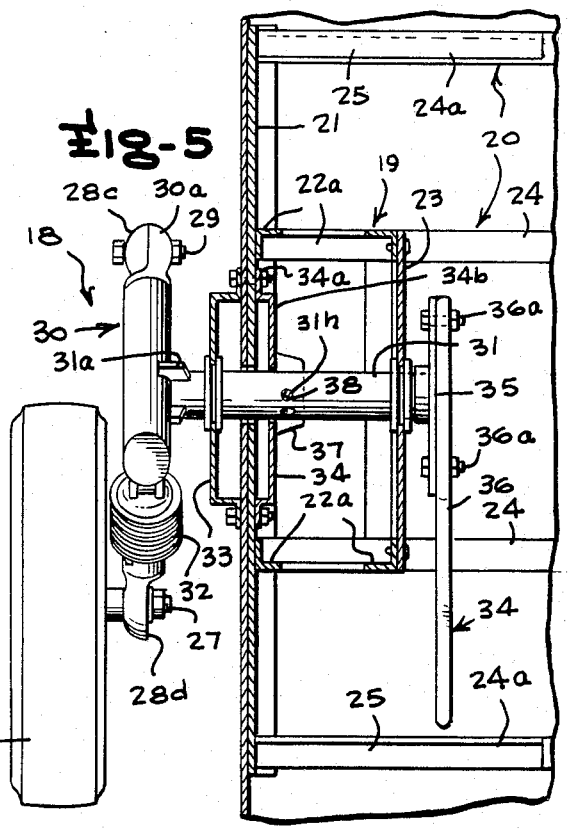
FIG. 5 is a fragmentary horizontal sectional view taken along line 5—5 of FIG. 4.

Each of the retractable outboard wheel assemblies 18 comprise a conventional wheel 26 formed of the usual hub and pneumatic tire journaled for rotation on an axle member 27 fixed in the lower end portion of a lower arm 28, formed for example of aircraft aluminum tubular parts 28*a* welded at opposite ends to knuckle formations 28*b* and 28*c* at the opposite ends thereof of generally hemispherical configuration at their outermost ends providing flat faces 28*d*. The uppermost knuckle formation 28*c* welded to the tubular part 28*a* of the lower arm 28 is coupled by a knuckle pin 29 to a similar knuckle formation 30*a* of an upper arm 30, similarly having an aircraft aluminum tubular member, and forming an articulated arm assembly with lower arm 28. Arm 30 has a coupling yoke or clevis 30*b* at the uppermost end thereof and is welded to a cylindrical axle tube 31 forming the main axle for each outboard wheel assembly 18. The axle tube 31 is also formed of an aircraft aluminum tubular member and is fixed against rotation relative to the upper arm 30 by reinforcing gusset plates 31*a* arranged in two diametric planes of the axle tube 31 located perpendicular to each other. The two pivotally intercoupled arms 28 and 30 are normally disposed in substantially the angular relationship illustrated in FIG. 4 by a shock absorber 32 having a surrounding spring 32*a*, and pivot couplings at its upper and lower ends pinned to the coupling yoke or clevis 30*b* of the upper arm 30 and a similar coupling yoke or clevis 28*e* welded to the tubular portion 28*a* of the lower arm 28 near its union with the lowermost knuckle formation 28*b* as shown in FIG. 4.

Figure 3:
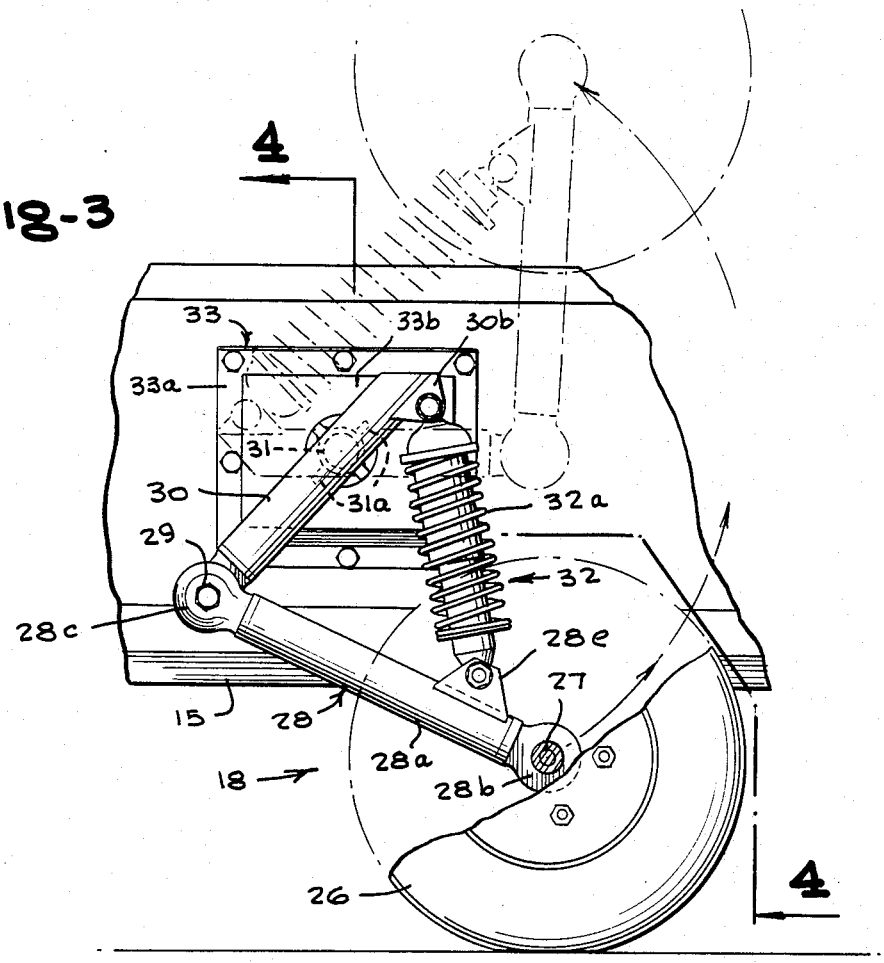
FIG. 3 is a fragmentary side elevational view, to enlarged scale, of one of the wheel assemblies.

The axle tube 31 of each retractable wheel assembly 18 is journaled and adequately supported in the adjacent sides 14 of the boat hull 11 by the wheel mount frame assemblies 19 previously described, and a pair of metallic hull bracket members 33, 34 having peripheral flange formations 33*a*, 34*a* bolted through appropriately positioned openings in flanges of the angle members forming the mounting frames 22 and the reinforcing side plates 21. The bracket members 33, 34 have planar plate portions 33*b*, 34*b* which are disposed parallel to each other when the bracket members 33, 34 are assembled in the position illustrated in FIG. 3, and have holes through which the axle tube 31 passes, the hole in at least the outermost member 33 having a supporting bushing and utilizing a nylon sleeve bearing, sized to the outer diameter of the axle tube 31.

The axle tube also extends through similar nylon sleeve bearing members in an axially aligned opening in the metallic plate bushing 23 of the associated mounting frame 22, providing sufficient support to maintain the center axes of the two axle tubes 31 on the opposite sides of the boat in concentric alignment with a common transverse axis perpendicular to the center vertical plane through the keel of the boat hull.

Figure 2:
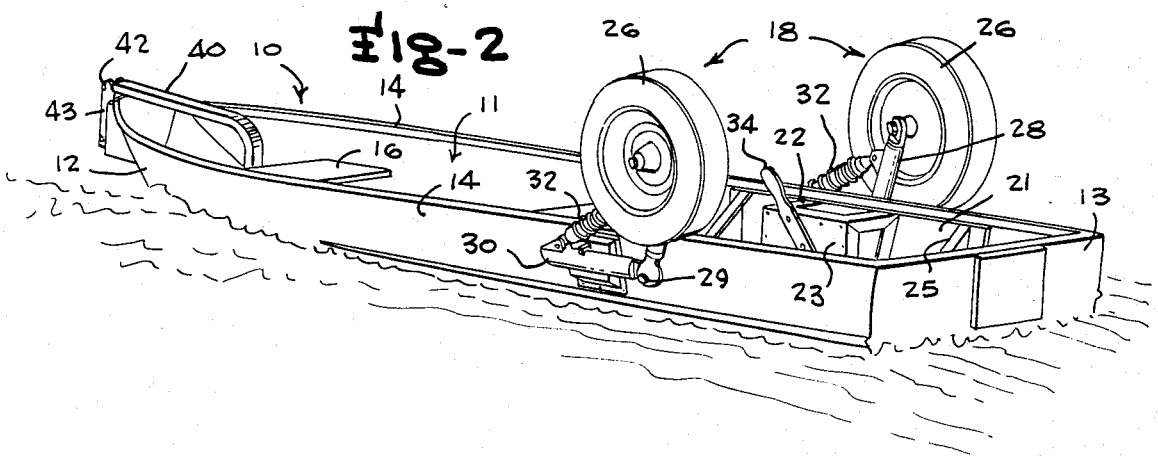
FIG. 2 is a perspective view of the combined boat and trailer assembly, showing the boat in waterborne condition with the wheels and wheel supporting structure in the elevated, waterborne mode.
Figure 6:
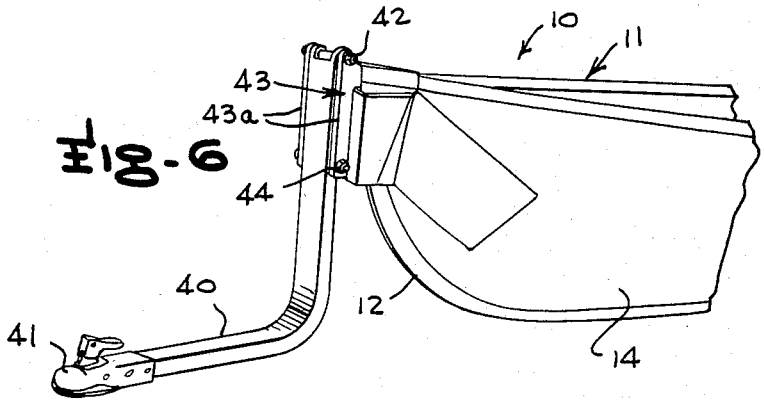
FIG. 6 is a fragmentary perspective view of the hitch assembly and adjacent portions of the boat.

The innermost end portions of the axle tubes 31, each include a lift handle assembly 34, which comprises an elongated metallic handle bracket 35 attached to the adjacent axle tube 31 so as to be rigidly held against movement relative to the adjoined axle tube 31, which, in the illustrated embodiment, has a pair of bolt holes near opposite ends thereof spaced an appropriate distance eccentrically and in diametrically opposite relation to the axis of the associated axle tube 31 to receive mounting bolts 36*a* extending through appropriate apertures in an elongated wheel assembly positioning handle member 36 here shown as a lifting handle made of wood. A locking pin bracket 37 is welded to the plate portions 34*b* of the inner hull bracket members 34 providing apertured flange formations immediately above and immediately below the axle tube 31 in the zone immediately inwardly of the plate portions 34*b*, to be aligned with either pair of two pairs of diametrically opposite locking pin aligning holes 31*h* and receive the locking pin 38 when the associated wheel assembly 18 is in the extended trailering position shown in FIG. 1 or in the raised waterborne position of FIG. 2. The removable locking pin 38 therefore provides a convenient, simple and inexpensive mechanism for positively retaining the wheel assembly associated therewith in either of the two above-mentioned positions.

While the handle bracket 35 and handle member 36 on the innermost end of each of the axle tubes 31 is the mechanism provided in the illustrated embodiment, it will be apparent that other known types of axle adjusting mechanisms may be provided, if desired, such as a crank mechanism or battery operated electrical drive means of known construction.

While various types of hitch arm mechanisms may be provided for attachment to the towing hitch of the towing automobile, the illustrated embodiment provides a generally L-shaped hitch arm having a conventional hitch coupler member 41 for receiving the hitch ball fixed to one end and being pivotally coupled by the bolt 42 to the hitch arm attachment bracket 43 welded to the bow of the metallic boat hull or molded into a fiberglass hull. The hitch arm attachment bracket 43 includes two laterally spaced, vertically elongated flange or plate formations having a pivot bolt 42 near their uppermost end and having a removable locking bolt 44 extending through apertures near the lower ends of the bracket flange members 43*a* to be aligned with a bolt receiving hole in the adjacent portions of the hitch arm 40 to lock the hitch arm in the towing position illustrated in FIG. 1 when desired. When the boat becomes waterborne, the lower locking bolt 44 is removed and the hitch arm 40 raised by rotating it about the upper pivot bolt 42 to swing it inside of the boat to an out-of-the-way position in the bow portion of the boat.

It will be appreciated that the basic wheel assembly concept described above may be employed on many different styles and configurations of small to medium size boats and to boats made of many boat hull materials without departing from the spirit or scope of the invention.

I claim:

1. A combination boat and trailer assembly movable on land and on water having outboard wheel assemblies and support structure therefor provided in integrated relation on the boat, wherein the wheels can be lowered to form a trailering system when it is desired to tow the boat and can be raised to positions withdrawing the wheel assemblies above normal water level when the boat is waterborne, comprising a boat hull having bow and stern end portions and boat hull sides, hitch means at the bow of the boat for removable attachment to a trailer hitch ball of a towing vehicle, said wheel assemblies each having a pair of pivotally intercoupled articulated rigid arms and an interconnecting shock absorber located outwardly adjacent opposite sides of the boat hull providing an upper arm and a lower arm, a ground engaging wheel rotatably journaled on the lower portion of said lower arm, said shock absorber resiliently maintaining said upper and lower arms substantially at an acute angle to each other within a predetermined angular range, a rigid axle member extending from and rigidly fixed to the upper arm intermediate its ends adapted to be disposed in horizontal position in use attitude of the boat, and a wheel assembly mounting frame structure fixed inwardly adjacent each side of the boat adjacent the wheel assemblies having means supporting a pair of axially spaced bearing members defining journal bearings aligned along a common axis extending transverse of the boat hull for the axle members associated with the respective wheel assemblies, and axle member rotating means located inboard of the boat affixed to inboard portions of each said axle member for rotating the axle members to angularly spaced first and second positions locating the wheel assemblies respectively in said lowered trailering position and in said raised position.

2. A combination boat and trailer assembly as defined in claim 1, where said upper and lower arms of said articulated rigid arms comprise a lower pivotal arm having knuckle formations at the upper and lower ends thereof and an upper pivoted arm having a knuckle fomation at the lower end thereof, the knuckle formations at the adjacent ends of said upper and lower arms having a knuckle pin intercoupling them, a wheel axle carried by the lower knuckle formation of said lower arm having the wheel of the associated wheel assembly rotatably journaled thereon.

3. A combination boat and trailer assembly as defined in claim 2, wherein said mounting frame structures include a rigid reinforcing plate fixed to and against the inner surfaces of opposite side walls of the boat hull, and a pair of inner and outer support plates fixed to said reinforcing plate and located adjacent inner and outer surfaces of each boat side wall are provided in alignment with each other having openings supporting said bearing members receiving and journaling the axle member for each wheel assembly.

4. A combination boat and trailer assembly as defined in claim 2, wherein said mounting frame structures include a rigid reinforcing plate fixed to and against the inner surfaces of opposite side walls of the boat hull, and a pair of inner and outer companion support plates ridigly supported from said reinforcing plate adjacent inner and outer surfaces of each boat side wall are provided in alignment with each other having openings supporting said bearing members receiving and journaling the axle member for each wheel assembly and rigid transverse reinforcing rib members fixed to and spanning the bottom of the boat hull and fixed adjacent their opposite ends to said frame structures.

5. A combination boat and trailer assembly as defined in claim 1, where said upper and lower arms of said articulated rigid arms comprise a lower pivotal elongated tubular arm having knuckle formations at the upper and lower ends thereof and an upper pivoted elongated tubular arm having a knuckle formation at the lower end thereof, the knuckle formations at the adjacent ends of said upper and lower arms having a knuckle pin intercoupling them, a wheel axle carried by the lower knuckle formation of said lower arm having the wheel of the associated wheel assembly rotatably journaled thereon.

6. A combination boat and trailer assembly as defined in claim 5, wherein said mounting frame structures include a rigid reinforcing plate fixed to and against the inner surfaces of opposite side walls of the boat hull, and a pair of inner and outer companion support plates fixed to said reinforcing plate and located adjacent inner and outer surfaces of each boat side wall are provided in alignment with each other having openings supporting said bearing members receiving and journaling the axle member for each wheel assembly.

7. A combination boat and trailer assembly as defined in claim 5, wherein said mounting frame structures include a rigid reinforcing plate fixed to and against the inner surfaces of opposite side walls of the boat hull, and a pair of inner and outer companion support plates rigidly supported from said reinforcing plate adjacent inner and outer surfaces of each boat side wall are provided in alignment with each other having openings supporting said bearing members receiving and journaling the axle member for each wheel assembly and rigid transverse reinforcing rib members fixed to and spanning the bottom of the boat hull and fixed adjacent their opposite ends to said frame structures.

8. A combination boat and trailer assembly as defined in claim 1, where said upper and lower arms of said articulated rigid arms comprise a lower pivotal arm having knuckle formations at the upper and lower ends thereof and an upper pivoted arm having a knuckle formation at the lower end thereof, the knuckle formations at the adjacent ends of said upper and lower arms having a knuckle pin intercoupling them, a wheel axle carried by the lower knuckle formation of said lower arm having the wheel of the associated wheel assembly rotatably journaled thereon, and clevis means adjacent the upper end of said upper arm and the lower end of said lower arm, the wheel shock absorber being coupled at its opposite ends to said clevis formations resiliently maintaining said upper and lower articulated rigid arms within a predetermined range of substantially acute angular relationships therebetween.

9. A combination boat and trailer assembly as defined in claim 8, wherein said mounting frame structures include a rigid reinforcing plate fixed to and against the inner surfaces of opposite side walls of the boat hull, and a pair of inner and outer companion support plates rigidly supported from said reinforcing plate and located adjacent inner and outer surfaces of each boat side wall are provided in alignment with each other having openings supporting said bearing members receiving and journaling the axle member for each wheel assembly.

10. A combination boat and trailer assembly as defined in claim 8, wherein said mounting frame structures include a rigid reinforcing plate fixed to and against the inner surfaces of opposite side walls of the boat hull, and a pair of inner and outer companion support plates rigidly supported from said reinforcing plate adjacent inner and outer surfaces of each boat side wall are provided in alignment with each other having openings supporting said bearing members receiving and journaling the axle member for each wheel assembly and rigid transverse reinforcing rib members fixed to and spanning the bottom of the boat hull and fixed adjacent their opposite ends to said frame structures.

11. A combination boat and trailer assembly as defined in claim 1, where said upper and lower arms of said articulated rigid arms comprise a lower pivotal elongated tubular arm having knuckle formations at the upper and lower ends thereof and an upper pivoted elongated tubular arm having a knuckle formation at the lower end thereof, the knuckle formations at the adjacent ends of said upper and lower arms having a knuckle pin intercoupling them, a wheel axle carried by the lower knuckle formation of said lower arm having the wheel of the associated wheel assembly rotatably journaled thereon, and clevis means adjacent the upper end of said upper arm and the lower end of said lower arm, the wheel shock absorber being coupled at its opposite ends to said clevis formations resiliently maintaining said upper and lower articulated rigid arms within a predetermined range of substantially acute angular relationships therebetween.

12. A combination boat and trailer assembly as defined in claim 11, wherein said mounting frame structures include a rigid reinforcing plate fixed to and against the inner surfaces of opposite side walls of the boat hull, and a pair of inner and outer companion support plates rigidly supported from said reinforcing plate and located adjacent inner and outer surfaces of each boat side wall are provided in alignment with each other having openings supporting said bearing members receiving and journaling the axle member for each wheel assembly.

13. A combination boat and trailer assembly as defined in claim 11, wherein said mounting frame structures include a rigid reinforcing plate fixed to and against the inner surfaces of opposite side walls of the boat hull, and a pair of inner and outer companion support plates rigidly supported from said reinforcing plate adjacent inner and outer surfaces of each boat side wall are provided in alignment with each other having openings supporting said bearing members receiving and journaling the axle member for each wheel assembly and rigid transverse reinforcing rib members fixed to and spanning the bottom of the boat hull and fixed adjacent their opposite ends to said frame structures.

14. A combination boat and trailer assembly as defined in claim 1, wherein said mounting frame structures include a rigid reinforcing plate fixed to and against the inner surfaces of opposite side walls of the boat hull, and a pair of inner and outer companion support plates fixed to said reinforcing plate at inner and outer surfaces of each boat side wall are provided in alignment with each other having openings supporting at least one of said bearing members receiving and journaling the axle member for each wheel assembly.

15. A combination boat and trailer assembly as defined in claim 1, wherein said mounting frame structures include a rigid reinforcing plate fixed to and against the inner surfaces of opposite side walls of the boat hull, and a pair of inner and outer companion support plates rigidly supported from said reinforcing plate adjacent inner and outer surfaces of each boat side wall are provided in alignment with each other having openings supporting said bearing members receiving and journaling the axle member for each wheel assembly and rigid transverse reinforcing rib members fixed to and spanning the bottom of the boat hull and fixed adjacent their opposite ends to said frame structures.

* * * * *